United States Patent [19]

Pierce

[11] Patent Number: 4,832,346

[45] Date of Patent: May 23, 1989

[54] COLLEGE FOOTBALL BOARD GAME

[76] Inventor: Marshall L. Pierce, 116 Pinecone Dr., Lawrence, Kans. 66044

[21] Appl. No.: 86,599

[22] Filed: Aug. 18, 1987

[51] Int. Cl.[4] ..... A63F 3/00

[52] U.S. Cl. ..... 273/247

[58] Field of Search ..... 273/247, 243, 256

[56] References Cited

U.S. PATENT DOCUMENTS

| | | | |
|---|---|---|---|
| 4,010,957 | 1/1982 | Tricoli | 273/256 |
| 4,027,882 | 5/1980 | Rosenberg | 273/247 |
| 4,189,153 | 11/1985 | Zollinger | 273/256 |
| 4,279,422 | 3/1980 | Shaw | 273/256 |

*Primary Examiner*—Richard C. Pinkham
*Assistant Examiner*—Benjamin Layno
*Attorney, Agent, or Firm*—Bacon & Thomas

[57] ABSTRACT

An apparatus for simulating the coaching career of a collegiate football coach. The game simulates factors encountered by a coach whose long term objective is to advance his career from coaching at a minor level team to a higher level team. The game utilizes a game board having an inside track and an outside track. The inside track is a recruiting season track which simulates the conditions involved in recruiting the best available players. The outside track is a playing season track where the coaches try to defeat other teams. The game begins by first moving pieces representing coaches along the inside track recruiting players during the first recruiting season and then proceeding to the first playing season on the outside track. A coaching year represents one lap around the recruiting season track and one lap around the playing season track. The game board and related pieces cooperate to give successful recruiting coaches a higher probability of achieving a successful playing season. At the end of each year, a successful coach who has had the most successful playing season will receive honors. Coaches advance to higher level coaching positions after a certain period of years. This period is reduced by being successful as a coach.

17 Claims, 8 Drawing Sheets

| REGION | MINOR LEVEL | MAJOR LEVEL | SUPER LEVEL |
|---|---|---|---|
| EAST | VILLANOVA | MARYLAND | PENN STATE |
| EAST | WAKE FOREST | SYRACUSE | PITTSBURGH |
| SOUTH | NEW MEXICO | TEXAS A & M | TEXAS |
| SOUTH | MEMPHIS STATE | HOUSTON | ARKANSAS |
| SOUTH | LOUISVILLE | LOUISIANA ST. | ALABAMA |
| MIDWEST | NORTHWESTERN | MISSOURI | NOTRE DAME |
| MIDWEST | MIAMI OF OHIO | PURDUE | MICHIGAN |
| MIDWEST | BALL STATE | MICHIGAN ST. | OHIO ST. |
| MIDLANDS | TULSA | SOUTHERN METHODIST | OKLAHOMA |
| MIDLANDS | WICHITA ST. | COLORADO | NEBRASKA |
| WEST | PACIFIC | STANFORD | SOUTHERN CAL |
| WEST | MONTANA ST. | ARIZONA ST. | UCLA |

FIG. 8

SCORE SHEET

| | | | | | | |
|---|---|---|---|---|---|---|
| (coach) | (coach) | (coach) | (coach) | (coach) | (coach) | (coach) |
| YEAR # 1 | | | | | | |
| (School) pts.( ) | (School) pts.( ) | (School) pts.( ) | (School) pts.( ) | (School) pts.( ) | (School) pts.( ) | (School) pts.( ) |
| YEAR # 2 | | | | | | |
| (School) pts.( ) | (School) pts.( ) | (School) pts.( ) | (School) pts.( ) | (School) pts.( ) | (School) pts.( ) | (School) pts.( ) |
| YEAR # 3 | | | | | | |
| (School) pts.( ) | (School) pts.( ) | (School) pts.( ) | (School) pts.( ) | (School) pts.( ) | (School) pts.( ) | (School) pts.( ) |
| YEAR # 4 | | | | | | |
| (School) pts.( ) | (School) pts.( ) | (School) pts.( ) | (School) pts.( ) | (School) pts.( ) | (School) pts.( ) | (School) pts.( ) |
| YEAR # 5 | | | | | | |
| (School) pts.( ) | (School) pts.( ) | (School) pts.( ) | (School) pts.( ) | (School) pts.( ) | (School) pts.( ) | (School) pts.( ) |
| YEAR # 6 | | | | | | |
| (School) pts.( ) | (School) pts.( ) | (School) pts.( ) | (School) pts.( ) | (School) pts.( ) | (School) pts.( ) | (School) pts.( ) |
| YEAR # 7 | | | | | | |
| (School) pts.( ) | (School) pts.( ) | (School) pts.( ) | (School) pts.( ) | (School) pts.( ) | (School) pts.( ) | (School) pts.( ) |
| YEAR # 8 | | | | | | |
| (School) pts.( ) | (School) pts.( ) | (School) pts.( ) | (School) pts.( ) | (School) pts.( ) | (School) pts.( ) | (School) pts.( ) |
| YEAR # 9 | | | | | | |
| (School) pts.( ) | (School) pts.( ) | (School) pts.( ) | (School) pts.( ) | (School) pts.( ) | (School) pts.( ) | (School) pts.( ) |
| YEAR # 10 | | | | | | |
| (School) pts.( ) | (School) pts.( ) | (School) pts.( ) | (School) pts.( ) | (School) pts.( ) | (School) pts.( ) | (School) pts.( ) |
| TOTALS( ) | ( ) | ( ) | ( ) | ( ) | ( ) | ( ) |

FIG. 9

COLLEGE FOOTBALL BOARD GAME

BACKGROUND OF THE INVENTION

1. Field of the Invention

The present invention relates to the field of board games of the type which simulate, in an amusing manner, the competition involved in collegiate sports, especially the competition between coaches in collegiate football. In particular, the game simulates the career of collegiate sport coaches, particularly football, by simulating their endeavor to recruit the best players, win games, become influential, and advance their career by eventually coaching the best college teams in the country.

2. Background Information

A number of board games are available which simulate sporting events and related subject matter. Some of these games are directed to various aspects of particular sports such as the acquisition of players, teams, and defeating other teams in simulated competition. Some board games stress the acquisition of teams while other stress different aspects of team sports such as winning a particular game.

Illustrative of available board games including games described in U.S. Pat. Nos. 4,010,957 and 4,027,882. Pat. No. 4,027,882 describes a board game which simulates building up and maintaining an athletic team and competition with other teams during a season. U.S. Pat. No. 4,010,957 describes a sports game board which simulates the acquisition of teams and players wherein the object of the game is to make the most amount of money by buying and selling the teams and players like pieces of property.

None of the above-mentioned games are directed toward simulating the coaching aspects of the sports. In particular, none of the prior games simulate the career of a coach, including his motivation and objective for himself as well as his team, as he tries to advance his own career while also trying to build up a good team and defeat the teams of his opponent coaches.

Typically, real life coaches start their career by coaching at schools of lesser sporting reputation. While coaching at a particular school, their immediate objective is to recruit the best players and win as many games as possible. They also have their own personal long range objective of eventually coaching and winning games at the best athletic schools. Many factors are involved in meeting these immediate and long range objectives. These factors include the ability to recruit the best players, the ability to win games, avoiding the violation of NCAA rules, gaining influence and recognition for successful coaching, and the ability to overcome various miscellaneous hurdles associated with coaching college teams over a long period of time.

The present invention incorporates all of these factors into a single game apparatus and method of play in a manner not achieved by any of the games presently available. In particular, the present invention simulates the immediate and long term objectives of collegiate football coaches as they endeavor to win games and enhance their influence and prestige by advancing to better coaching positions at more prestigious schools.

SUMMARY OF THE INVENTION

It is an object of the present invention to provide a board game which simulates the athletic and career objectives of collegiate football coaches who are trying to advance their career from minor level coaching positions at less prestigious athletic schools to super level coaching positions at the most prestigious athletic schools.

It is also an objective of this invention to provide a game which combines the objectives of recruiting players, winning games and advancing the career of the coach, in a single game.

It is also an objective to provide a method of playing the game which simulates the objectives of a coach who is trying to advance his career.

These and other objectives are met by providing an apparatus which comprises numerous elements which allow the players to play a chance and decision making game in which players act as big time college football coaches. The game is played on a game board divided into one area for simulating a recruiting season and another area which simulates a playing season. In addition to the game board, the apparatus comprises additional elements which provide for the players to compete for a plurality of seasons, preferably ten seasons, each of which contains a recruiting season and a playing season. The apparatus also provides for the coaches to advance their career from minor level coaching positions to major level and then to super level coaching positions while at the same time allowing them to engage in the lively and entertaining recruiting and intercollegiate competition associated with college football. The game apparatus also provides different geographical regions in which coaches try to advance their career objectives.

The apparatus required for playing the game includes a game board; tokens, which are movable over the surface of the game board; a chance generating device, such as a conventional pair of dice or other device which can randomly generate numbers; six categories of game cards; a "road to success chart" adapted to provide each player with their own career objective and a particular type of score card adapted to record the advancement of the coaches on a yearly basis from one level to the next and also to record the points achieved by each coach for each year.

An important aspect of the apparatus is the game board. The game board is divided into two tracks, one track being on the inside and the other track being on the outside of the board. One of the tracks, preferably the inside track, comprises an inner periphery of squares or intervals which define a "recruiting season". The other track, preferably the outside track, comprises a periphery of squares or intervals which defines a "playing season".

The inside recruiting season track simulates the conditions involved in recruiting the best available players. The outside track simulates a playing season wherein the coaches try to defeat other teams. The game begins by first recruiting players during the first recruiting season and then proceeding to the first playing season on the outside track. The coaches play a predetermined number of "years" in which each year comprises one recruiting season and one playing season. The game board and related pieces cooperate to give successful recruiting coaches a higher probability of achieving a successful playing season. At the end of each year, a successful coach who has had the most successful playing season will receive "honors". The game board also provides means for the coach to gain influence or an "interest" in a particular geographic region. The reception of honors and having an interest in the coaches geographic region, enhances the coaches probability of advancing his career to a higher coaching level. The object of the game is to advance a long term career objective by achieving the highest level of coaching and achieving the most amount of points in the process.

It will be understood that the term "squares" are not necessarily squares in the geometric sense, but are only intervals which are marked off on the board. Also, the phrase "to land on a square" means the square upon which a token lands after the token has been moved a given number of squares as determined by a chance event.

The squares of the inner track are selected to provide a wide assortment of events which occur when coaches compete among themselves in recruiting the best players available. In order to simulate this aspect of coaching, the inner track comprises different categories of squares. One category of square (recruiting or player squares) provides for the acquisition of players or recruits. Not all of the recruiting squares are alike in order to simulate the fact that not all players are alike in their ability to play. Some players have known skills, such as All-American players and Heisman Trophy candidates, while other players are considered "longshots" and have potential to develop into outstanding players. In addition, there are some players who are average and have no particular potential to develop into an outstanding player. Additionally, there are some players who have a particular ability such as speed or a good arm.

One object of the recruiting squares is to simulate the recruitment of players from a wide variety of outstanding talent and also to take into consideration a certain element of risk involved in recruiting players who may later become excellent players. In order to accomplish this objective, some squares direct a participant, i.e., a coach, to receive an excellent player, such as an All-American. The "All-American" squares may direct a coach to select a particular All-American player, such as an Eastern Interest All-American or an All-American of the coach's particular region. Preferably, some of the All-American squares will give a coach a choice in deciding which All-American player to select. Some squares, preferably only one instruct a coach to receive a particularly valuable recruit such as a Heisman Trophy candidate. Other squares simply instruct a coach to select a recruit of average ability. These are termed "juco" recruiting squares. Additional squares may be provided which instruct a coach to select a "star" player who has a particular talent, such as a strong arm for running speed.

In order to introduce an element of risk into recruiting the best players, some recruiting squares are provided wherein the ability of the player is determined by a chance event which is conducted after the coach selects the player. Squares of this type are called "longshot" recruiting squares.

The game comprises two phases. The first phase is a "recruiting season" phase and is played by the coaches advancing their tokens around the inner track wherein their objective is to recruit the best players This phase of the game is known as the "recruiting season" and the recruiting season may terminate after one coach goes completely around the inner track. Coaches advance their token around the inner track in accordance with a chance event, preferably dice, most preferably one die. The coaches take turns in an ordered sequence. Whenever a coach lands on a recruiting square, he has the option of selecting the player indicated by the square, or one of his own choice if the square permits. Preferably, the coach will be limited in the number of players they may recruit during the recruiting season.

A plurality of player or recruit cards is provided. These cards correspond to the recruiting squares. Each recruiting square will have at least one corresponding recruit card. The recruit cards have indicia thereon to identify the type of player and will further indicate the value of the player (power rating) by means of a numerical rating printed on one face of the card. The longshot cards will have the power rating expressed in the alternative wherein one alternative is zero and the other is a number higher than zero. An example would be, zero or seven. The actual rating is determined by each chance event, such as the roll of a die.

The power rating for each player is also indicated on the corresponding squares.

The "All-American" cards will also indicate the particular geographic region to which the player is associated.

The player cards are also provided with an opposing surface, which is opposite the side having the indicia which indicates the player's power rating. The opposing side is blank or, alternatively, it may contain suitable indicia to indicate that the particular player has a power rating of zero, regardless of what power rating is indicated on the face side. Thus, the card may be used face down to indicate that the power rating of a longshot player is zero. Likewise, if the longshot player's power rating is determined to be the alternative number other than zero then it would be used face up. In addition, the opposing side serves to indicate that the power rating of any other player is zero, as may occur during the course of the game because of injury or punitive measures taken against the team or individual players.

The inner track also provides additional types of square to simulate additional aspects of coaching which may occur in college sports. One aspect of coaching relates to the advancement of the coach's career objective. In real life, coaches will try to further their career objective by gaining influence among their peers within their own geographic region. For example, Eastern area coaches will try to gain a reputation to boost their chances of ultimately being hired as a coach at a leading school in their region. In order to simulate this aspect of coaching, the game may provide an "interest" square on the inside track which directs a coach to choose a particular interest card or one of his own choice.

An interest card is provided for each geographic region. When a coach lands on an interest square, he is permitted to pick up an interest card providing one is available. Under certain circumstances, possession of an interest card for the particular region of a coach, allows the coach to proceed to a higher coaching level in fewer years than would be otherwise possible without possession of the card.

In real life, coaches try to hire assistant coaches who are known to be 'top recruiters'. Having a top recruiter on their staff gives coaches an advantage during recruiting. This aspect of coaching is simulated by providing a "top recruiting square" and a plurality of corresponding "top recruiter" cards. Preferably, at least one top recruiting square is provided in the recruiting season track.

When a player lands on a top recruiter square he may select a top recruiting card and keep it for later use to obtain one additional roll of the die at the end of the recruiting season. The additional roll of the die increases the coach's probability of recruiting a desirable player and thus serves to simulate the real life advantage of having an assistant coach who has excellent recruiting skills. If the coach is not eligible to recruit players at the end of the season, then he may not use the card.

Also in real life coaching, some aspects of the coach's ability to recruit are not attributable to the coach's skill or that of assistants, but are instead the result of chance events. In order to simulate these chance events, the game provides some squares with instructions to roll a die or instructs the coach to advance his token to another square, thus providing a simulated aspect of luck in the recruiting of players.

In addition to recruiting players from the large pool of available players, coaches in real life sometimes find it advantageous to attract players from the teams of their fellow coaches. When a plurality of coaches are trying to "steal" a player from another team, it may involve, to say the least, some vigorous action by the coaches on one hand to prevent the loss of one of their better players or, on the other hand, to win over an outstanding player from another team. This condition is simulated by providing at least one square which subjects coaches who land on that square to the risk of losing a player to another coach. This square may be called a "dogfight" square. When a coach lands on the dogfight square, he risks losing one of his players to another coach who is eligible to recruit players add this loss is dependent on a chance occurrence such as the roll of a die or dice. The individual coach who receives the player is also determined by a chance event.

Another feature of the recruiting season track involves the scrutiny by the NCAA which is an important factor in real life recruiting. In order to simulate NCAA scrutiny, and consequential punitive measures taken against teams which violate NCCA rules, NCAA squares are provided in the recruiting season track. Preferably, two types of NCAA squares are provided, one being an "NCAA minor infraction" square and the other being an "NCAA major infraction" square. When a coach lands on one of the NCAA squares he is penalized in accordance with the severity of the infraction. The NCAA minor infraction requires that the coach turns over one of his playing cards, if he has any, to indicate that the player's power rating is zero. Instructions to that effect may be placed on the square. Typically, a plurality of NCAA minor infraction squares are located around the recruiting season track.

The NCAA minor infraction penalty diminishes the coach's overall team power rating. The team power rating is the sum of the individual player power ratings. As a result, a coach who has been penalized in this manner will enter the playing season with a diminished team power rating. Consequently, his chance of success during the playing season will be diminished.

An NCAA major infraction requires that all of the coach's player cards be turned over to indicate a total team power rating of zero. The infraction also requires that the coach no longer participates in the recruiting season for the remainder of the year. Preferably, the major infraction square will instruct the coach to turn over his player cards and also direct him to move his token to the playing season opener square on the outside track and wait for the playing season to begin. The recruiting season ends when the first coach reaches the season opener square on the outside track. Each coach then proceeds to advance his token around the playing season track which is located on the outer periphery of the board.

In order to facilitate the transition from the inside track to the outside track, and vice versa, the game board provides a recruiting season starting square in the outer track next to the first square of the recruiting season track. Indicia, such as an arrow pointing into the first recruiting season's square, is placed on the board at this location to show that tokens on the recruiting season's square move into the inner track by advancing onto the first square of the recruiting season track and thereafter moving in the direction of the arrow around the inner track. The first square of the recruiting season also contains an arrow or other indicia pointing into the adjacent corner square of the outer track playing season. This arrow directs a player to leave the inner track after going around it once. The above-mentioned corner square serves as the "season opener" and it may have an arrow for directing movement around the outer track.

After the coaches have completed the first recruiting season they then proceed to the playing season. Preferably, the recruiting season is finished when one coach has reached the season opener square without incurring an NCAA major infraction. However, coaches who hold a top recruiting card obtain one more roll of the die if they are still eligible to recruit players. Coaches are limited to the number of players they may recruit during a recruiting season. Preferably, they are limited to three players.

The playing season also requires the coaches to take turns in advancing their tokens around the playing season track. Preferably, the coach who is most successful in the recruiting season goes first since going first has a distinct advantage and, in order to simulate a real life situation, coaches with the best players should have an advantage.

The outside track cooperates with additional types of game cards and a chance generating device whereby coaches having teams with the highest power rating are more likely to go around the outside track faster than the other coaches. The first coach who goes around the playing season track without incurring an NCAA major infraction wins "honors" for the first year. The game continues for a predetermined number of years, preferably ten. The object is to advance to the higher coaching positions within the coach's geographical region. Preferably, a coach must advance through three coaching levels. Advancement is automatic after a predetermined number of years (preferably three) but advancement is accelerated after two years providing the coach has won honors at his current coaching level and also holds the interest card for his geographical region.

The playing season track contains different types of squares which affect the number of turns a player takes to advance around the board. One category of square makes it more likely that coaches of high rated teams will have a greater probability of success during the playing season. This is accomplished by providing at least one square having indicia thereon which instructs a player to compare his team power rating with that of a score card. The square further instructs a coach to advance his token in response to a chance event, such as the roll of a pair of dice, if his team power rating is greater than that which is indicated on the score card he picks. A plurality of score cards are provided having different scores printed on the face side thereof.

Another category of squares indicates further movement by either instructing the coach to roll the dice again or to advance to a particular square. Both of these types of squares serve to enhance the coach's immediate goal of being the first coach to go around the playing season and thereby win honors for that particular year. Typically, these squares indicate some desirable event which is beneficial to the coach or the team and they thus serve to simulate these desirable events by enhancing the coach's likelihood of receiving honors. Likewise, additional squares are provided which simulate undesirable events and they are simulated by indicating the end of a coach's term.

At least one square is provided in the playing season track which instructs a player to pick up a top recruiter card. A plurality of top recruiter cards is provided, preferably one for each player. The top recruiter card is held by the coach and may be used to obtain one extra roll of the die at the end of the recruiting season.

At least one interest area square is provided for each geographic region. A set of matching interest cards is provided so that coaches may pick up the appropriate interest card when landing on this square. Preferably, one card is provided for each of five interest areas. Additionally, at least one square is provided which instructs a coach to pick up the interest card of his choice.

Another type of square is provided to simulate the various types of events which may occur during the playing season and which will affect the team's or the coach's performance. These squares have indicia which instruct a player to pick up a matching card. These squares and the matching cards simulate the "breaks of the game" and are, therefore, termed "break" squares and cards. A plurality of break cards are provided which are either "good breaks" or "bad breaks". A good break card has indicia on one side which instructs a player to advance his token in accordance with a chance event such as a roll of a die. The bad break cards have indicia on one side to signify that the coach's turn is over.

Another type of space is provided in the playing season track which simulates other types of events and are termed "big cigar" squares. At least one big cigar square is provided and each one has indicia thereon which instructs a player to pick up a matching big cigar card. A set of matching big cigar cards is provided so that a player landing on a big cigar square may pick up a card. The big cigar card my have various written instructions on one side thereof. Preferably, these cards will instruct a player to receive an interest card, or signify the end of a player's turn, or indicate an NCAA major infraction, or instruct a coach to receive a top recruiter card or instruct a coach to advance his token in response a chance event such as the roll of a die or instruct a coach to advance his token or end his turn contingent upon some other event.

The outer track also contains at least one square to simulate an event which diminishes a team's overall strength. Preferably, at least one square is provided to indicate that a player is injured (injury square) and at least one square is provided to indicate that there has been an NCAA major infraction (NCAA major infraction square). The injury square has indicia to instruct a coach to turn over his highest rated player card which diminishes his team's overall power rating. The NCAA major infraction square has indicia which instructs a coach to turn over all his player cards and instructs him to refrain from taking part in the remainder of the playing season, thus, precluding his chance of gaining honors for that particular year.

As stated previously, each coach chooses a region within which he tries to advance his career. Each region is indicated on a chart. For each region, at least one series of colleges is indicated, one for each coaching level.

The game also provides a score sheet which is adapted to keep a record of the coach's progression through each coaching level and to keep track of the reception of honors and points for each year.

The chance event may be a pair of conventional dice and may be used as a pair or individually. Preferably, a single die is used on the inside track and a pair of dice is used on the outside track.

The tokens are conventional. The only requirement is that they be visually distinguishable from each other to avoid confusion. Thus, they may have different colors and/or shape.

BRIEF DESCRIPTION OF THE DRAWINGS

FIGS. 1A, 1B, 1C, and 1D fit together as shown in FIG. 1 to form a plan view of the game board of the preferred embodiment.

FIG. 8 is a plan view of a road to success chart employed in the preferred embodiment.

FIG. 9 is a plan view of a score sheet used in the preferred embodiment.

DESCRIPTION OF THE PREFERRED EMBODIMENT

The preferred embodiment of the apparatus and method of play will now be described with reference to FIGS. 1–9.

Figure 1:
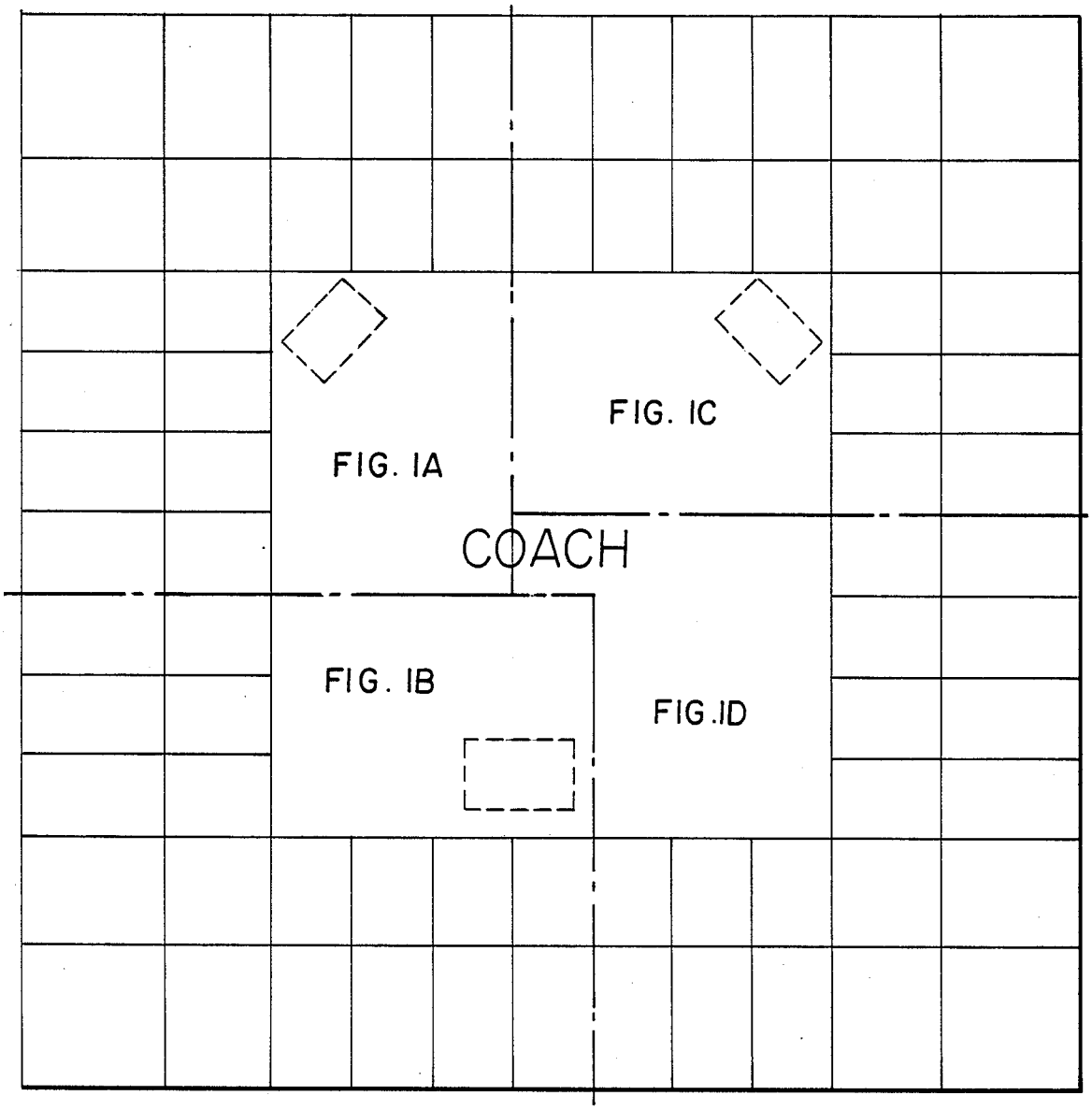
FIG. 1 is a plan view of the game board which shows how FIGS. 1A, 1B, 1C, and 1D fit together to form the game board of the preferred embodiment.
Figure 1A:
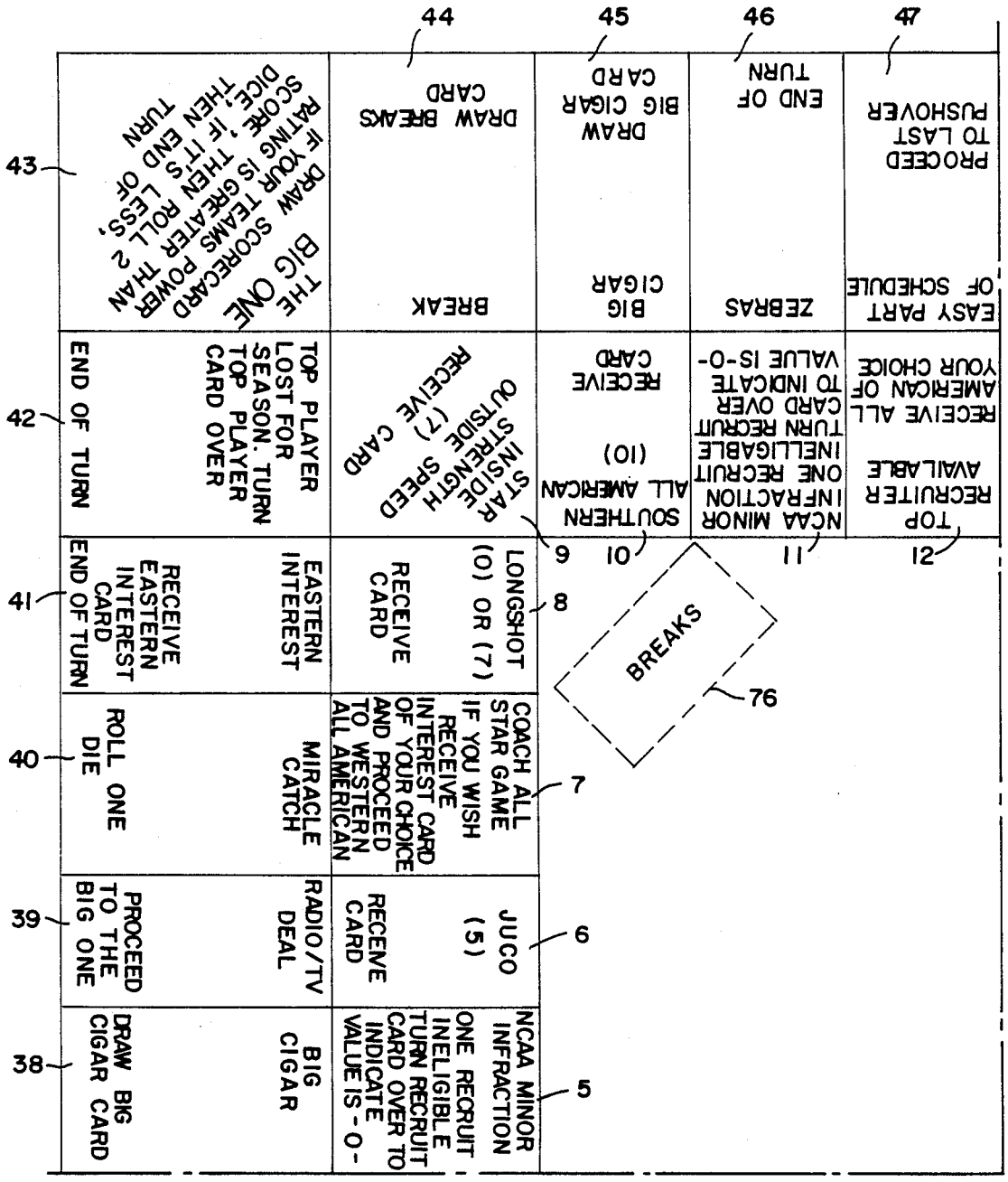
Figure 18:
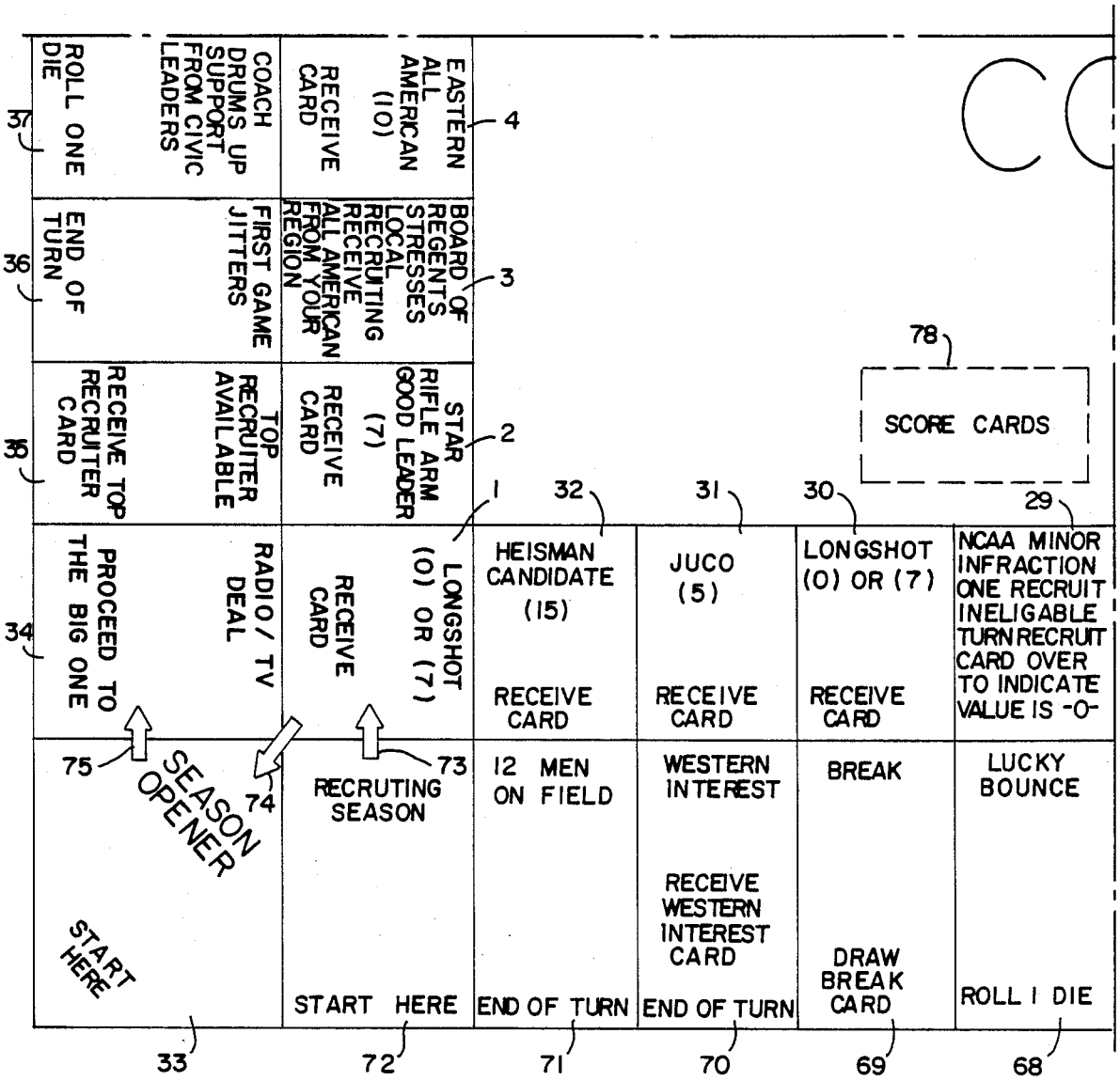
Figure 1C:
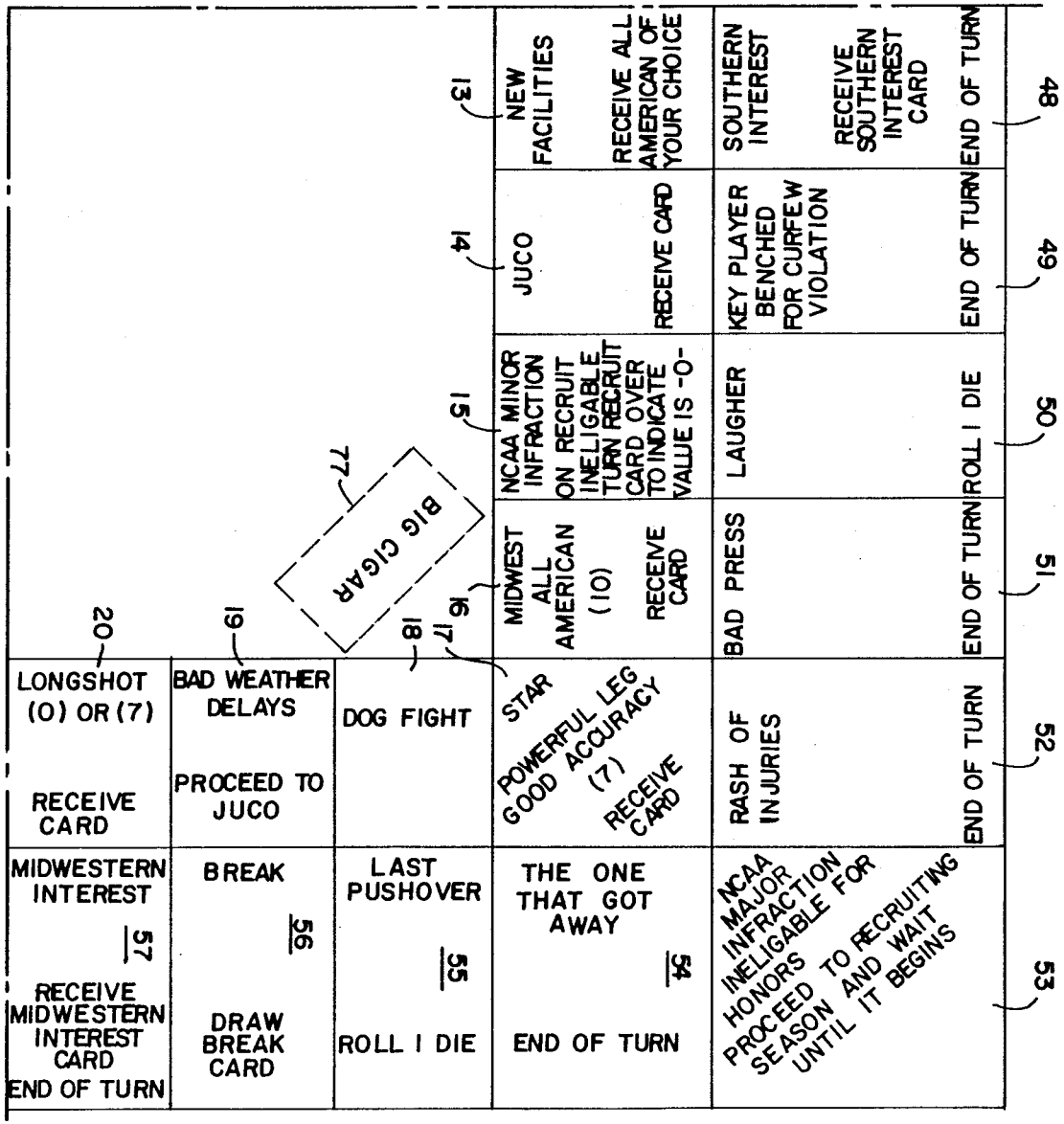
Figure 10:
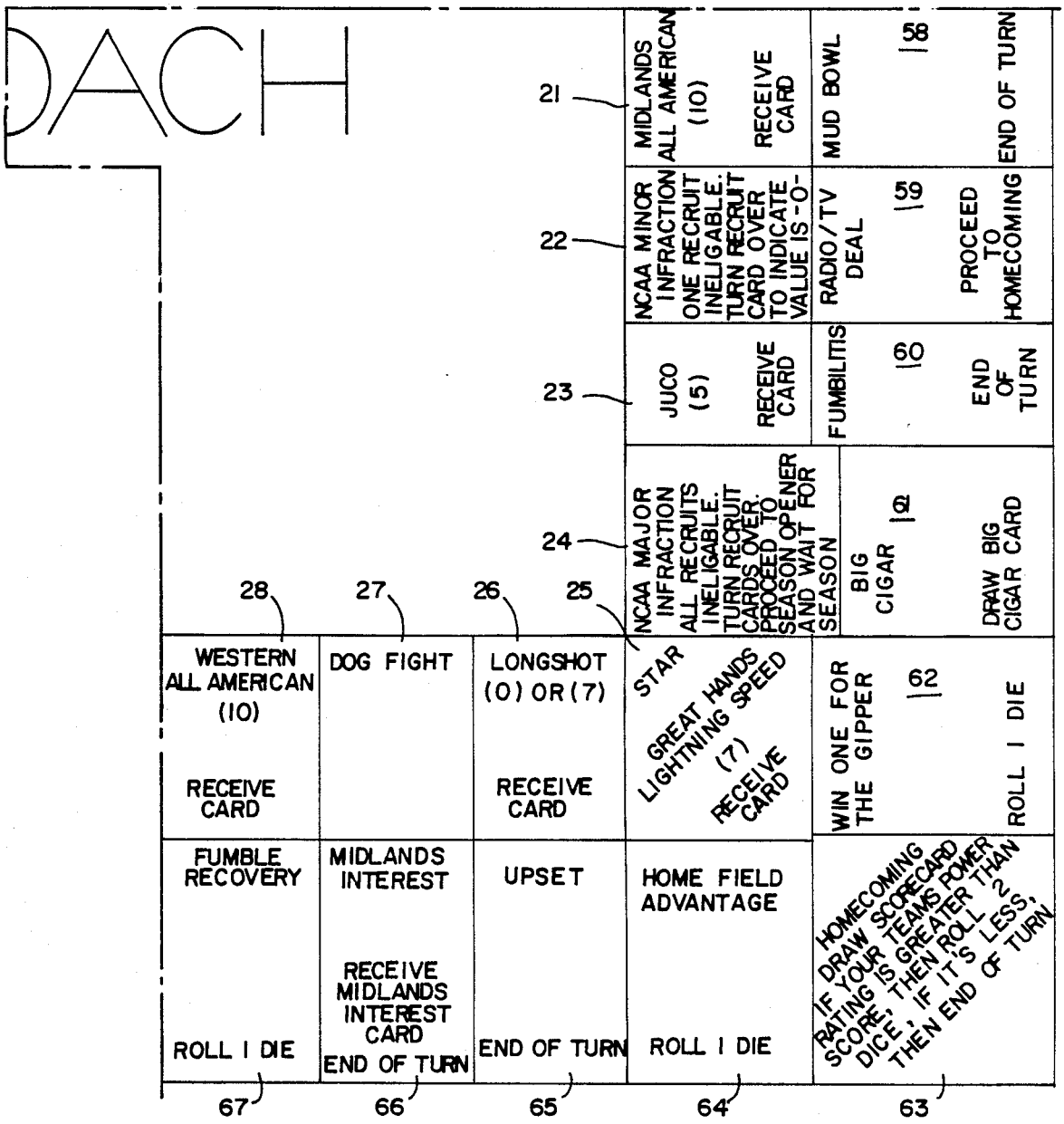

It will be noted that FIG. 1 does not contain the lettering or numerals shown in FIGS. 1A, 1B, 1C, and 1D since the only function of FIG. 1 is to show how FIGS. 1A–1D fit together to form the game board of the preferred embodiment.

With reference to FIGS. 1A, 1B, 1C, and 1D the game board has an inside track which comprises squares 1–32 and an outside track which comprises squares 33–72. Square 72 in the outside track is used as the starting point for the inside track. An arrow 73 indicates the direction of play to remind coaches that when they reach square 72, they should then begin play on the inside track when the recruiting season begins. Likewise, square 1 has an arrow 74 pointing into the season opening square 33. Square 33 also has an arrow 75 directing coaches to advance their tokens in the direction of square 34 to initiate the playing season.

Each square on the board is marked with appropriate indicia as shown in FIGS. 1A, 1B, 1C and 1D to instruct the players and identify each square. Thus, each coach will know what to do at each move by reading the square upon which he lands.

In addition, the preferred game board may further include ornamental designs for each type of square and the squares may have different colors to provide visual enhancement and ease of identification. However, these additional ornamental and color features are not necessary to practice the invention or its preferred embodiment.

Each player square contains a number, or a pair of numbers in the case of a longshot player square. These numbers match up with the numbers on the corresponding player cards. The game board contains the following types of playing squares: All-American, Longshot, Heisman Candidate, Juco, and Star players.

The central region of the board has areas 76, 77 and 78 marked off for the placement of cards thereon.

The game cards used in the preferred embodiment are as follows.

Figure 2:
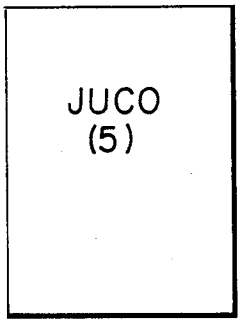
FIGS. 2 and 2A are plan views of the two sides, respectively, of one of the player cards used in the preferred embodiment.
Figure 2A:
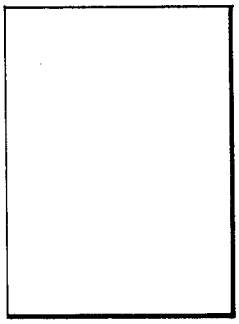

Player cards—in the preferred embodiment twenty-eight player cards are provided. On the face of each player card, the type of player and the player's power rating is identified. This is illustrated in FIG. 2 for one of the playing cards. The power rating is the number shown in parentheses in FIG. 2. The opposite side of each player card is blank, as shown in FIG. 2A. The information contained on the face of the twenty-eight player cards is shown in Table 1:

TABLE 1

| Player Card | Number of Cards | Information on face side |
|---|---|---|
| Longshot | 9 | Longshot (0) or (7) |
| Juco | 9 | Juco (5) |
| Star | 1 | Great hands lightning speed (7) |
| Star | 1 | Powerful leg good accuracy (7) |
| Star | 1 | Inside strength outside speed (7) |
| Star | 1 | Rifle arm good leader (7) |
| All-American | 1 | Midlands All-American (10) |
| All-American | 1 | South All-American (10) |
| All-American | 1 | West All-American (10) |
| All-American | 1 | East All-American (10) |
| All-American | 1 | Midwest All-American (10) |
| Heisman Trophy Candidate | 1 | Heisman Trophy Candidate (15) |

In addition, the face of each player card may include the color and ornamental design features found on their corresponding player squares of the game board.

Figure 3:
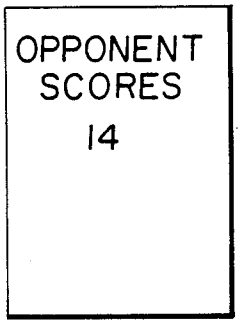
FIGS. 3 and 3A are plan views of the two sides, respectively, of one of the score cards used in the preferred embodiment.
Figure 3A:
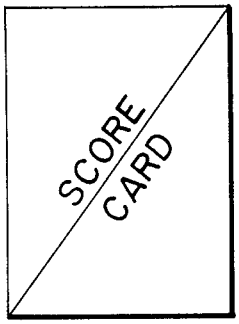

Score cards. In the preferred embodiment, twenty-three score cards are provided. On the face side of each card is the phrase "Opponent Scores" followed by a number which indicates the opponent's score. An example is shown in FIG. 3. On the opposite side of each score card is the word "Scorecard" as shown in FIG. 3A. The twenty-three score cards contain the following scores: 49, 21, 17, 34, 24, 0, 42, 27, 27, 12, 6, 3, 35, 14, 31, 24, 28, 10, 9, 7, 24, 23 and 14.

Figure 4:
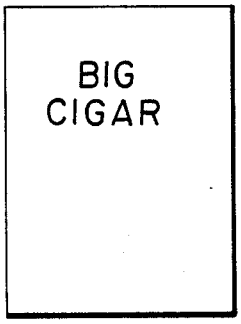
FIGS. 4 and 4A are plan views of the two sides, respectively, of one of the big cigar cards used in the preferred embodiment.
Figure 4A:
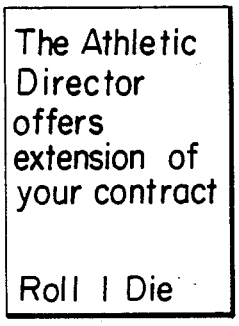

Big Cigar cards. In the preferred embodiment fifteen big cigar cards are provided. On one side of each card is the phrase "Big Cigar" which identifies the card as shown in FIG. 4. The identification side of these cards may also contain suitable ornamental design and/or color to match the corresponding squares on the board. The opposite or face side of each card contains a message with instructions for the coach to follow. The fifteen cards contain the following messages, one message per card, as illustrated in the examples shown in FIG. 4A.

1. Midwestern interest; receive Midwestern interest card; end of turn.
2. Western interest; receive Western interest card; end of turn.
3. Southern interest; receive Southern interest card; end of turn.
4. Eastern interest; receive Eastern interest card; end of turn.
5. Midlands interest; receive Midlands interest card; end of turn.
6. People like your style. Receive interest card of your choice; end of turn.
7. The people at this school are willing to pay the price. Receive top recruiter card and roll one die.
8. Special radio and TV deal. Draw score card. If your team's power rating is greater than the score card, then roll two dice; otherwise, end of turn.
9. The alumni like a coach who has been number one. If you have ever achieved honors then roll one die; otherwise, end of turn.
10. The athletic director offers extension of your contract. Roll one die.
11. The chancellor does not think football is all that important. End of turn.
12. When you're hot you're hot and when you're not . . . End of turn.
13. There's a good old boy who'd like to have your job. End of turn.
14. Powerful alumni keep interfering in the program. End of turn.
15. NCAA major infraction. Proceed to recruiting season and wait for the recruiting season to begin. Void in tenth season.

Figure 5:
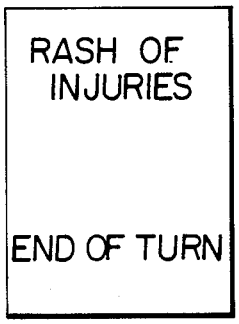
FIGS. 5 and 5A are plan views of the two sides, respectively, of one of the break cards used in the preferred embodiment.
Figure 5A:
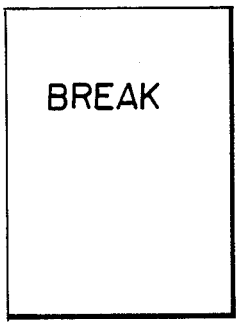

Break Cards. In the preferred embodiment, fifteen break cards are provided. On the face of each card is a message with instructions for the coach to follow. An example is shown in FIG. 5. On the opposing side of each break card is the word "Break" as shown in FIG. 5A. The face of each card may also contain suitable decorative design and/or color to match the corresponding squares on the board. The fifteen break cards contain the following messages, one message per card as illustrated in the examples shown in FIG. 5A:

1. Win one for the gipper. Roll one die.
2. Home field attendance advantage. Roll one die.
3. Coach drums up support from local civic leader. Roll one die.
4. Lucky bounce. Roll one die.
5. First game jitters. End of turn.
6. Bad press. End of turn.
7. Rash of injuries. End of turn.
8. Opponent fumbles in their own end zone—your team recovers. Roll one die.
9. Miracle catch. Roll one die.
10. Key player benched for curfew violation. End of turn.
11. The one that got away. End of turn.
12. The governor said you snatched defeat from the jaws of victory. End of turn.
13. Upset. End of turn.

14. Zebras. End of turn.
15. Laugher (you win 99-3). Roll one die.

Figure 6:
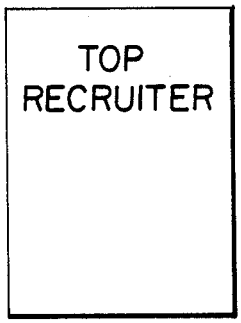
FIGS. 6 and 6A are plan views of the two sides, respectively, of one of the top recruiter cards used in the preferred embodiment.
Figure 6A:
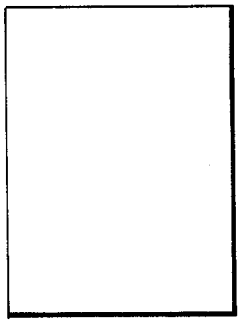

Top Recruiter Cards. In the preferred embodiment, five top recruiter cards are provided. On the face of each card is the phrase "Top Recruiter". Additional indicia to match the corresponding square on the board may be provided if the square on the board contains any such additional indicia. The face of a top recruiter card is shown in FIG. 6. The opposite side of the card is blank as shown in FIG. 6A.

Figure 7:
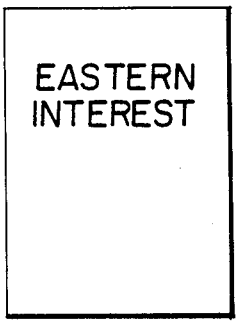
FIGS. 7 and 7A are plan views of the two sides, respectively, of one of the interest cards used in the preferred embodiment.
Figure 7A:
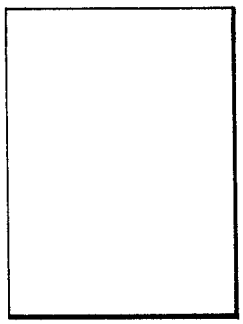

Interest Cards. In the preferred embodiment, five interest cards are provided. The interest area or region is identified on the face of each interest card such as the one shown in FIG. 7. The opposite side of each card is blank, as shown in FIG. 7A. The face of each card may further contain any other indicia, such as an ornamental design or color, to match the corresponding square on the board. The interest areas identified on the face of each card are as follows: Eastern Interest, Midwest Interest, Western Interest, Southern Interest, and Midlands Interest.

A "Road to Success" chart is shown in FIG. 8. The road to success chart indicates the teams in various regions and at different coaching levels.

The score card is shown in FIG. 9. The score card identifies each year and provides space for the coaches to indicate their chosen teams. A space is provided on the top of each card to enter the name of each coach. Spaces are also provided to record points obtained for achieving honors at the end of each year.

In operation, the game is played by first choosing a score keeper who keeps score and distributes the game cards. The score keeper may be a coach. The game board is opened and the Big Cigar, Break and Score Cards are placed on the board, face down in the space allotted them in the central region of the board. After the board is set up, the coaches roll dice to determine the order of play. Play begins with the highest roller and continues in a counterclockwise direction.

Next, the coaches observe the road to success chart and select a road to success in order of their turn, by choosing a coaching position at one of the colleges indicated in the minor level column that is directly across from the super level position he wishes to ultimately coach. For example, if a coach wishes to ultimately coach at Penn State, the coach will choose a minor level position at Villanova. The score keeper records the coaches names on the top of the score card in the spaces provided for "(coach)". The minor level school name chosen for each coach is entered in the space marked "(school)" directly below each coach's name. When this is complete, the game may begin and the record of each coach's progress is recorded along a vertical column proceeding down the score card from year 1 to year 10.

After the score cards are set up, the coaches select their tokens, one token per coach. The tokens are placed on square 72 (recruiting season square) located on the outside track. Beginning with the coach who first chose a road to success, and continuing to the left, each coach rolls one die and moves his token on the inner track in the direction of arrow 73, the number of squares indicated by the die. The coaches follow the instructions on the square upon which their token comes to rest.

Playing in the inside track constitutes the recruiting season. Coaches may recruit a maximum of three players during the recruiting season. The recruiting season continues until one of the coaches reaches square 33 on the outside track without incurring an NCAA major infraction. Coaches cross over from the inner track to the outer track by following the arrow 74 which directs coaches to proceed from square 1 to square 33. Once the first recruiting season ends, coaches may not recruit any more players unless they hold a top recruiter card in which case they may roll the die one more time if they are still eligible to recruit players and are still on the recruiting season track.

During the recruiting season, coaches recruit players as indicated by the square upon which they land. The objective is to recruit the players with the highest power rating which is indicated on the cards and the matching square on the board. The total of all the players' power rating is called the team power rating.

When a coach lands on a player square he may recruit the player indicated by the square by obtaining possession of the matching player game card if it has not already been chosen by another player. Preferably, the score keeper distributes the cards. Once a player card is received it cannot be traded, exchanged or discarded except as provided for by landing on the "dogfight" square 27.

It will be observed that the power rating of each player is fixed except for the "longshot" players. The power rating of a longshot is not determined until after a coach receives a longshot player card. The power rating is then determined by rolling one die. If the coach rolls a one or a six, then the power rating is (7), otherwise it is (0). A power rating of (0) is indicated by turning the card face down.

When a coach lands on a NCAA minor infraction square, such as square 5, he must turn over a player card to indicate that the player's power rating has been reduced to zero. If the coach has no players when he lands on the NCAA minor infraction square, then he is excused.

When a coach lands on a NCAA major infraction square on the inside track, then he must turn over all his player cards to indicate that each player has a power rating of (0). In addition, he must place his token on the square marked "season opener" and remain on that square with no further turns until the playing season starts. If all the players incur an NCAA major infraction during a particular recruiting season, then the recruiting season is over and the playing season begins.

When a coach lands on one of the squares marked "dogfight", all the other coaches still eligible to receive player cards roll one die, beginning with the coach to the left of the coach on the square and continuing to the left. Then the coach on the square rolls one die. If the coach on the square loses the roll, then the highest roller gets to receive from among the cards in possession of the coach on the square, the card of his or her choice. If the coach on the square is the highest roller or if he ties for the high roll, then the player card in questions remains with the coach. If there is a tie involving coaches other than the coach on the square, those coaches roll again until a high roller is determined.

The playing season begins after the recruiting season is over. The playing season is initiated when the first coach takes his turn by rolling a pair of dice. The coach with the highest team power rating goes first and play continues to his left. If there is a tie in the highest power rating, then the tied coaches roll the dice to see who goes first. The coach who rolls the highest number will go first.

The coaches take their turn by rolling the dice and advancing their token in accordance with the number indicated by the dice. The coach then follows the instruction written on the square upon which the token comes to rest. If doubles are rolled, a coach may advance the number of squares indicated by one die or two dice.

If a coach lands on a "Big Cigar" square, he draws a big cigar card from the top of the pile of Big Cigar cards located in the central region of the board. He then follows the instructions written on the face of the card. After following the instructions, he places the card face down on the bottom of the pile.

If a coach lands on a "Break" square he draws a break card from the top of the pile of Break cards similarly located in the central region of the board. He then follows the instructions written on the face of the card. After following the instructions, the coach places the card face down o the bottom of the pile.

A coach is entitled to receive an interest card by landing on the appropriate square or being obstructed to obtain one in accordance with the instructions in a big cigar card. Whenever a coach is entitled to receive an interest card, he may receive it from the score keeper if it is available. A coach may not have more than one interest card in his possession at any one time. However, coaches may return the interest card they have in order to be eligible to receive a more desirable interest card. It is most desirable for coaches to obtain an interest card in the region they are playing. For example, a coach who is playing in the Eastern region should try to obtain an eastern interest card.

If a coach lands on the "Big 1" or "Homecoming" square, squares 43 and 63, respectively, he is entitled to draw a score card. If the coach team power rating is higher than the opponent's score indicated on the score card, then he is entitled to roll the dice and advance his token accordingly.

If a coach lands on the NCAA major infraction square on the outer track, or otherwise incurs an NCAA major infraction during the playing season, he must refrain from further play in the current playing season. Furthermore, he must advance his token to square 72 marked "Recruiting Season". The coach then remains on square 72 until the next recruiting season begins.

The first coach to reach the recruiting season space, without incurring an NCAA major infraction, receives "honors" for the year. The number of points earned by receiving honors is determined by the coaching level he is coaching at. The coach receives one point for the minor level, 2 points for the major level, and 3 points for the super level. Only one coach may receive honors in a given year. The coach's points are recorded on the score card in the column under the coaches name for the appropriate year in the space provided in parentheses. The first year of play is over after completing the first recruiting season and playing season. After the first year, the players return all their playing cards and begin a new year by commencing a second recruiting season. The coach who most recently won honors goes first. If no coach wins honors, such as may happen if all the coaches incur an NCAA major infraction during the playing season, then the order of play remains unaltered.

Coaches may advance from one coaching level to the next automatically after three years of play. However, if a coach has one honor and has possession of an interest card for his region, then he may advance to the next level after two years. Advancement to the next level is recorded on the score card by writing in the name of the next level school on the score card. Coaches must turn in their top recruiter cards and interest cards upon advancing to a higher coaching level.

The game continues for ten game years. At the end of the tenth playing season (year 10), the score keeper totals the honor points won by each coach and the coach with the highest total is declared the coach of the decade and the winner of the game. If more than one coach has the same total of honor points, then the coach who won honor points the most years is the winner. If two or more coaches have the same total honor points and number of years, then the winner is the coach who most recently won honors.

While the present invention has now been described in terms of certain preferred embodiments, one skilled in the art will readily appreciate that various modifications, changes, omissions and substitutions may be made without departing from the spirit thereof. It is intended, therefore, that the present invention be limited solely by the scope of the following claims.

I claim:

1. A board game for simulating the career of a college sports coach which comprises:

a game board having a playing surface thereon;

a plurality of tokens movable over the surface of the game board, each token representing a coach;

means of chance for generating numbers to indicate the movement of each token over the board;

a chart for selecting teams;

a plurality of score cards, each of which has indicia on the face side thereof for indicating an opponent's score;

a plurality of player cards each of which has indicia on the face side thereof for identifying a category to which the indicated player belongs and a numerical power rating for the player and an opposite side of the card for indicating that the player's power rating is diminished to zero when the card is placed face down;

at least one card for each of a plurality of geographic regions, each card having indicia on the face side thereof for indicating the region; said surface of the playing board having first and second tracks of serially-linked squares; one track being an outer track located around the periphery of the board and the other track being an inner track located around inside periphery of the outer track; said first track for playing a recruiting season and said first track comprising:

(1) a plurality of player-square categories having different numerical power ratings assigned to each category; each category being represented by at least one player square for coaches to recruit and each player square having at least one corresponding player card whereby they may acquire a team of players having a team power rating defined by the sum of individual player power ratings;

(2) at least one square having indicia thereon to indicate an NCAA minor infraction, and (3) at least one square having indicia thereon to indicate an NCAA major infraction; said second track defining a playing season which comprises:

(1) a plurality of squares with indicia thereon for instructing a coach to receive a score card; said indicia granting him permission to advance his token a number of squares indicated by the number generated by the means of chance, on condition that his team power rating exceeds the score indicated on the score card so that coaches who have the highest team power rating have a greater portability of being first to go around the playing season track, (2) a plurality of squares with indicia thereon to indicate further movement o the token, (3) a plurality of squares with indicia thereon to indicate the end of a turn, (4) at least one interest area square for each geographic region represented in the interest cards, said interest area squares corresponding with the regions indicate in the interest cards and said interest area squares entitling a coach to receive the corresponding interest area card, and (5) at least one square with indicia thereon to indicate an NCAA major infraction; said chart comprising indicia which lists each geographic region contained on the board and also indicates, for each region, a plurality of teams in ascending order from a lowest level to a highest level.

2. The game board of claim 1, which further comprises at least one region square located in the first track; said square having indicia thereon to indicate a geographic region and entitling a coach to receive a corresponding interest area card.

3. The board game of claim 2, which further comprises a plurality of top recruiter cards having indicia on the face side thereof for indicating that a coach is a top recruiter; and said first and second tracks have at least one square thereon with indicia instructing a coach to receive a top recruiter card.

4. The game board of claim 3 which further comprises a plurality of break cards having indicia on the face side thereof, some of which indicate fortunate events by instructing a coach to advance his token in accordance with a number generated by the means of chance, and some of which indicate unfortunate events by instructing a coach that his turn is over; and said second track further comprises a plurality of squares having indicia thereon instructing a coach to receive a break card.

5. The board game of claim 4 which further comprises a plurality of big cigar cards having indicia on the face side thereof for indicating a message selected from the group consisting of:

instructions to receive an interest card;

instructions to advance a token in accordance with a chance event;

instructions to receive a top recruiter card;

instructions to indicate the end of a turn, and instructions to indicate an NCAA major infraction; said second track further comprises a plurality of squares having indicia thereon instructing a coach to receive a big cigar card.

6. The board game of claim 5 which further comprises at least one square in the second track having indicia thereon to indicate a player has been injured and his power rating is diminished.

7. The board game of claim 6 wherein the first track contains at least one square having indicia thereon which requires that a coach landing on said square must give up one of his player cards to another coach, said requirement being conditional upon an event determined by the means of chance.

8. The board game of claim 7 wherein the first track is on the inside and the second track is on the outside.

9. The board game of claim 8 wherein a square is provided on the outside track adjacent to a square on the inside track; and said outside track square is provided with indicia for indicating the starting point for playing on the inside track.

10. The board game of claim 9 wherein the player squares and player cards represent football players.

11. The board game of claim 10 wherein the categories of players indicated by the player cards and corresponding player squares include at least one Heisman Trophy candidate; a plurality of longshot players; a plurality of juco players; at least one All-American player from each region; and a plurality of star players; wherein the Heisman Trophy candidate has a power rating of fifteen; the Juco player has a power rating of five; the All-American players have a power rating of ten; the Star players have a power rating of seven; and the Longshot players have a power rating expressed in the alternative zero or seven.

12. The board game of claim 11, wherein the NCAA minor infraction requires a coach to turn over one of his player cards to indicate a power rating of zero.

13. The board game of claim 12, wherein the NCAA minor infraction square located on the first track requires a coach to turn over one of his player cards to indicate a power rating of zero.

14. The board game of claim 13, wherein the NCAA major infraction square located on the first track requires a coach to turn over all his player cards to indicate team power rating of zero and which further disqualifies a coach from further play in a recruiting season.

15. The board game of claim 14, wherein the NCAA major infraction square located on the second track disqualifies a coach from further play in the playing season.

16. The board game of claim 15, wherein the big cigar card which indicates an NCAA major infraction disqualifies a coach from further play in a playing season.

17. The board game of claim 1 which further comprises a score sheet.

* * * * *